US007080968B2

(12) United States Patent
Blackwell et al.

(10) Patent No.: US 7,080,968 B2
(45) Date of Patent: Jul. 25, 2006

(54) LOADING SYSTEM AND METHOD OF USE

(75) Inventors: Wayne M. Blackwell, Chenango Forks, NY (US); Bruce H. Hanson, Endicott, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 86 days.

(21) Appl. No.: 10/801,644

(22) Filed: Mar. 17, 2004

(65) Prior Publication Data

US 2005/0207879 A1 Sep. 22, 2005

(51) Int. Cl.
*B65G 47/30* (2006.01)
*B65G 59/00* (2006.01)

(52) U.S. Cl. ..... 414/798.9; 198/418.6; 198/607

(58) Field of Classification Search ..... 414/790.4, 414/790.5, 798.9, 798.7, 798.5; 198/418.6, 198/429, 531, 532, 550.2, 607
See application file for complete search history.

(56) References Cited

U.S. PATENT DOCUMENTS 2,936,909 A * 5/1960 Gard ..... 198/443
4,125,253 A * 11/1978 Wangermann ..... 270/52.06
4,613,268 A * 9/1986 Capdeboscq et al. ..... 414/796
4,919,589 A * 4/1990 Krappitz et al. ..... 414/798.9
4,951,934 A * 8/1990 Prins ..... 271/181
5,427,226 A * 6/1995 Ueda et al. ..... 198/418.6
5,503,518 A 4/1996 Scholz
5,556,254 A * 9/1996 Darcy et al. ..... 414/798.1
5,779,432 A * 7/1998 Pena ..... 414/794.4
5,820,334 A * 10/1998 Darcy et al. ..... 414/798.1
6,024,533 A * 2/2000 Redden ..... 414/798.9
6,834,755 B1 * 12/2004 Jay ..... 198/418.6

* cited by examiner

*Primary Examiner*—Douglas Hess
(74) *Attorney, Agent, or Firm*—Greenblum & Bernstein, P.L.C.

(57) ABSTRACT

A system and method for loading product onto a conveyor. The system includes a conveyor movable in at least a first direction and a metering section located proximate to at an end of the conveyor. The metering section includes a plate mechanism movable between a first position and a second position and a door adapted to be opened to a feeder. The door is at least partially supporting a predetermined amount of product and is positioned between a movable distance of the plate.

21 Claims, 5 Drawing Sheets

LOADING SYSTEM AND METHOD OF USE

BACKGROUND OF THE INVENTION

1. Field of the Invention

The invention generally relates to a loader and method of use and, more particularly, to a loading system for loading product onto a feeder and a method of use.

2. Background Description

The sorting of mail is a very complex, time consuming task. In general, the sorting of mail is processed though many stages, including back end processes, which sort or sequence the mail in delivery order sequence. These processes can either be manual or automated, depending on the mail sorting facility, the type of mail to be sorted such as packages, flats, letters and the like. A host of other factors may also contribute to the automation of the mail sorting, from budgetary concerns to modernization initiatives to access to appropriate technologies to a host of other factors.

In general, however, most modem facilities have taken major steps toward automation by the implementation of a number of technologies. These technologies include, amongst others, feeding systems, letter sorters, parcel sorters, advanced tray conveyors, flat sorters and the like. As a result of these developments, postal facilities have become quite automated over the years, considerably reducing overhead costs and becoming more efficient.

For example, feeders are typically used to feed mail and other product to sorters and sequencers. The feeders may include a loading ledge with a conveyor system divided into several uniformly spaced apart compartments. These compartments are divided by fixed compartment walls or paddles. The paddles are spaced, in one implementation, at about three inches apart from one another. To maximize throughput of the system, the compartments should be completely filled by placing the product between the paddles. This has to be performed on an ongoing basis as the conveyor is feeding (moving) the mail or product to the sorter or sequencer. Otherwise, the feeder will become "starved" and the throughput of the system will decrease.

To date, the filling of the compartments with product is still performed manually. That is, an operator breaks down the presented mail or product into small bundles, approximately three inch bundles, and places these bundles between the fixed paddles. To maximize throughput, the mail or product should completely fill the space.

However, besides being almost impossible for an operator to accomplish such fill on a consistent basis, the process of loading these bundles becomes tiresome to the operator. Thus, because of these problems and potential inconsistencies in filling the compartments, feeder starvation may become a problem. That is, there may be an inability to maintain the product feed into the feeder thus reducing the ability to keep up with the feed rate of the conveyor resulting in feeder starvation and reducing throughput. As a result of feeder starvation, mail or other product cannot be efficiently placed with the sorter or sequencer for sorting and sequencing of the mail or product.

The invention is directed to overcoming one or more of the problems as set forth above.

SUMMARY OF THE INVENTION

In one aspect of the invention, a system is provided for loading product. The system includes a conveyor movable in at least a first direction and a metering section located proximate to at an end of the conveyor. The metering section includes a plate mechanism movable between a first position and a second position, and a door adapted to be opened to a feeder. The door is at least partially supporting a predetermined amount of product and is positioned between a movable distance of the plate.

In another aspect of the invention, the system includes a conveyor movable in a first direction and a second direction and a plate positioned at an end of the conveyor and movable independent of the conveyor. A second plate is positioned at another end of the conveyor and is moved in synchronized movement with the conveyor in at least the first direction. A door is positioned proximate the second plate and is adapted to release product to be fed to a feeder.

In still another aspect of the invention, a loading and transporting system includes a first movable conveyor having a plurality compartments each having a predetermined width, and a second moveable conveyor incrementally movable toward a loading area of the first movable conveyor. Also provided is a holding area designed to hold a plurality of mail pieces on the second moveable conveyor and a metering section located proximate to the holding area. The metering section includes a plate mechanism movable between a first position and a second position remote from the second moveable conveyor and a door having a length substantially equal to the predetermined width of each of the plurality compartments. The door supports a predetermined amount of mail pieces. A control incrementally moves the mail pieces onto the door until a number of mail pieces substantially occupies the length of the door. The control also opens the door to load the number of mail pieces to each of the plurality compartments.

In yet another aspect of the invention, a method is provided for loading product. The method includes the steps of placing product on a conveyor and incrementing the product towards a metering section until the product placed within the metering section is substantially a same width as a compartment on a feeder conveyor. The product is released from the metering section to the compartment on the feeder in a same orientation.

DETAILED DESCRIPTION OF EMBODIMENTS OF THE INVENTION

The invention is directed to a loading system for loading mail, flats and other product (hereinafter referred to generally as product) onto a feeder conveyor and method of use. The loading system is implemented with a feeder used to feed the product to sorters and/or sequencers. In embodiments, the loading system automatically loads bundles of product onto the conveyor system of the feeder within the discrete compartments, i.e., between the paddles. In this manner, the loading system maximizes throughput of the feeder and hence the sorter and/or sequencer by ensuring that the compartments are completely or substantially completely filled (i.e., fully utilized) throughout the process. Essentially, the loading system of the invention will prevent feeder starvation, and ensure an even, steady flow of product onto the conveyor without user intervention. Other applications such as warehousing and storage applications are also contemplated for use with the invention.

Loading System of the Invention

Figure 1:
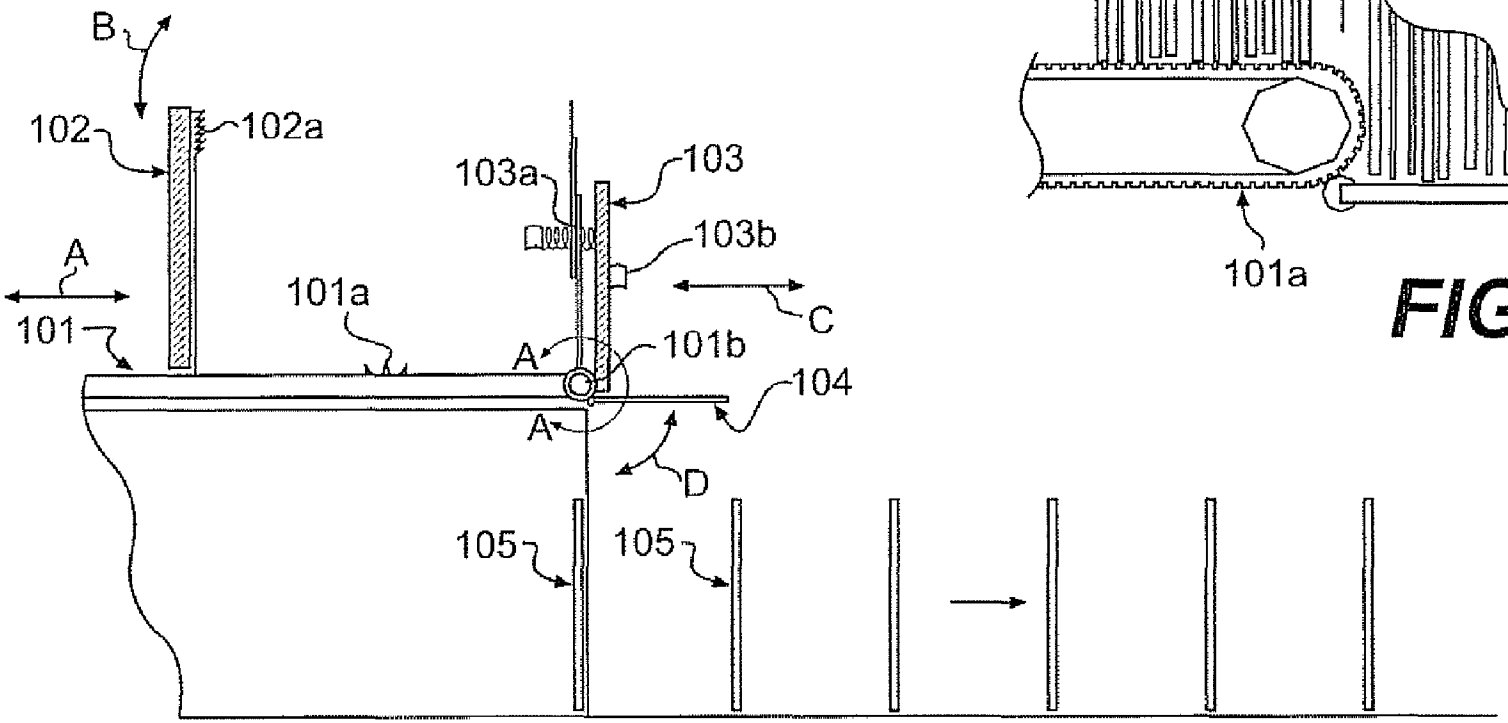
FIG. 1 shows a schematic diagram of the loading system of the invention.

Referring now to FIG. 1, a schematic diagram of the loading system of the invention is shown. In the embodiment of FIG. 1, the loading system is generally depicted as reference numeral 100 and includes a conveyor 101 and a movable plate 102. The conveyor 101 is any well known conveying device 101 such as a conveyor belt, driven by any known mechanism such as, for example, electric motors, chain drives and the like. In one implementation, the conveyor belt 101 includes cogs 101*a*, forming gaps or grooves of about $32^{nd}$ to $64^{th}$ of an inch. The grooves are designed to create a defacto separation of the product as the product is deposited onto a metering section (discussed below)

The movable plate 102 is movable in the directions of arrow "A". In embodiments, the plate 102 is chain driven and is independent of the movement of the conveyor 101. The plate 102 may be mounted on a pawl system 102*a*, which allows the plate 102 to disengage from the chain drive when lifted in the direction of arrow "B". In one implementation, the plate 102 can be lifted at about 15 degrees from the plane of the conveyor 101 in order to initially load product onto the conveyor 101.

Still referring to FIG. 1, an opposing movable plate 103 is provided on an opposing end of the conveyor 101, from the movable plate 102. A photodiode or other optical sensor 103*b* may be mounted on the plate 103 or proximate thereto. The plates 102 and 103 may be at any distance from one another, at the initial stage of operation; however, in one implementation, a distance of about 30 inches is contemplated.

In one implementation, the movable plate 103 is spring loaded, via a spring 103*a*, and is movable in the directions of arrow "C". The spring load allows force to be exerted on the product on the conveyor, between the plates 102 and 103 and additionally allows the plate 103 to return to an original position after release of product onto the feeder. The plate 103 is movable within a metering section defined by drop gate 104, and may be provided with a hard stop or controlled stop via the photodiode.

The drop gate 104 is movable between a first position and a second position, as represented by arrow "D". The drop gate 104 is positioned at least at the height of the conveyor 101 and preferable at a bottom section of the conveyor, below radius 101*b*. The drop gate 104 is further positioned such that in the second (opened) position, an edge. 104*a* of the drop gate 104 will be above the paddles 105 of the feeder. This will ensure that the drop gate 104 will not interfere with the motion of the paddles and hence will not interfere with the throughput of the feeder. The drop gate 104 may be moved via any conventional mechanism such as a solenoid, linear actuator or other mechanism. The system is controlled and synchronized or coordinated by a controller 110, as discussed below.

Figure 2:
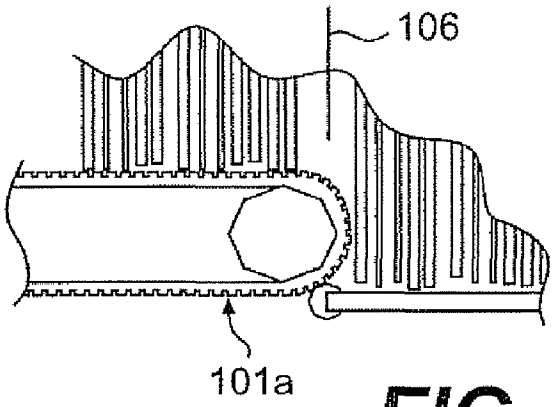
FIG. 2 shows an exploded view of the loading system at section A—A of FIG. 1.

FIG. 2 shows an exploded view of section A—A of FIG. 1. As seen in FIG. 2, the cogs 101*a* create grooves on the conveyor 101. With the drop gate 104 positioned below the radius 101*b* of the conveyor 101, the grooves will provide a defacto separation of the product as the product is deposited within the metering section (as defined by the drop gate 104 and the plate 103 which is moved into a position substantially at the edge 104*a* of the drop gate 104). That is, the grooves, which are embedded in the conveyor belt 101, hold back additional pieces of product from falling within the metering section when a metered amount of product is already placed on the drop gate 104. This is accomplished, in one embodiment, by reversing the direction of the conveyor belt at a predetermined distance, while the grooves "catch" the product thus moving the product away from the metering section.

Alternatively or in addition to the above mechanism, in one embodiment, a knife blade 106, for example, may be inserted between the product to ensure that no further product is inserted within the metering section. The knife blade 106 may be rotated between a lifted position, so as not to interfere with the product, and a lowered position, between the product on the conveyor and a last product placed in the metering section. It should be understood that the metering section should hold enough product to fill the space between the paddles 105.

Figure 3:
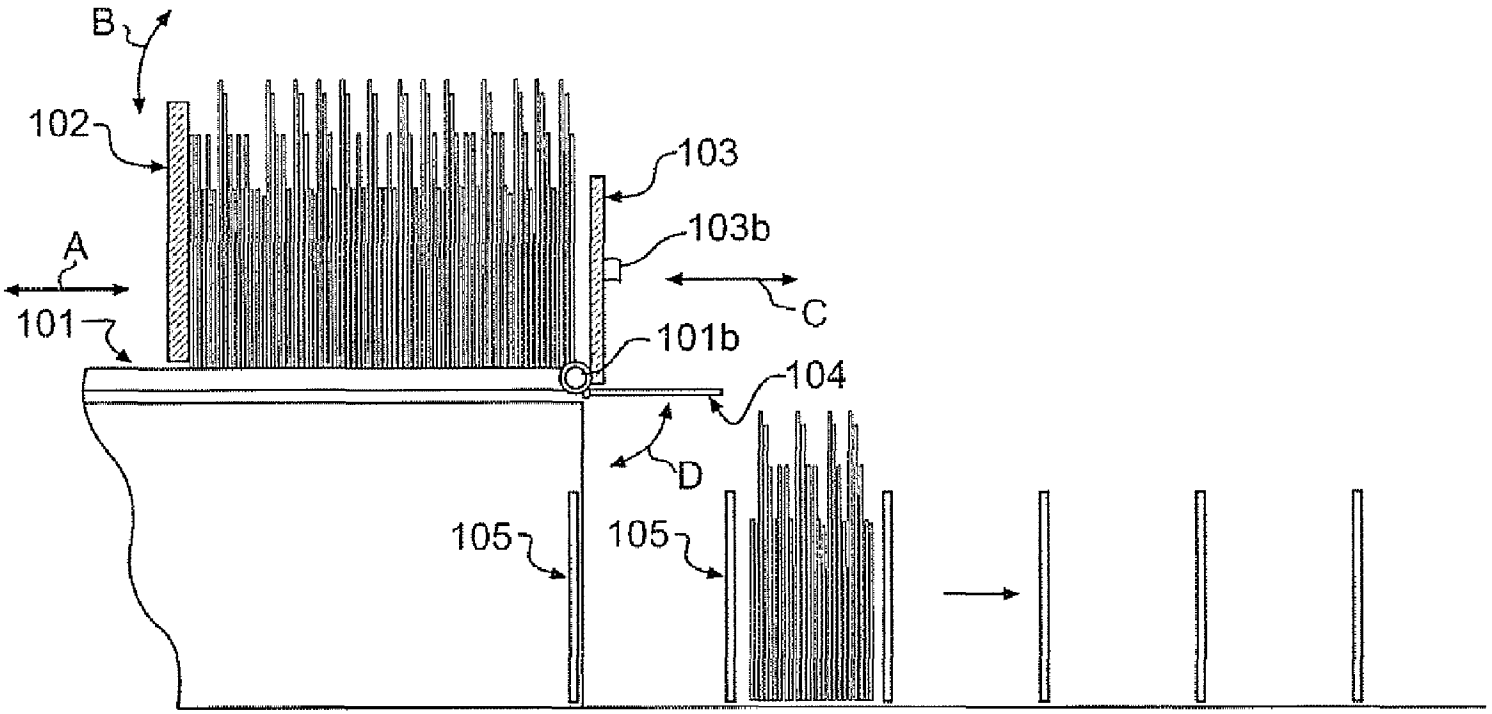
FIG. 3 shows the loading system of the invention in a stage of operation.
Figure 4:
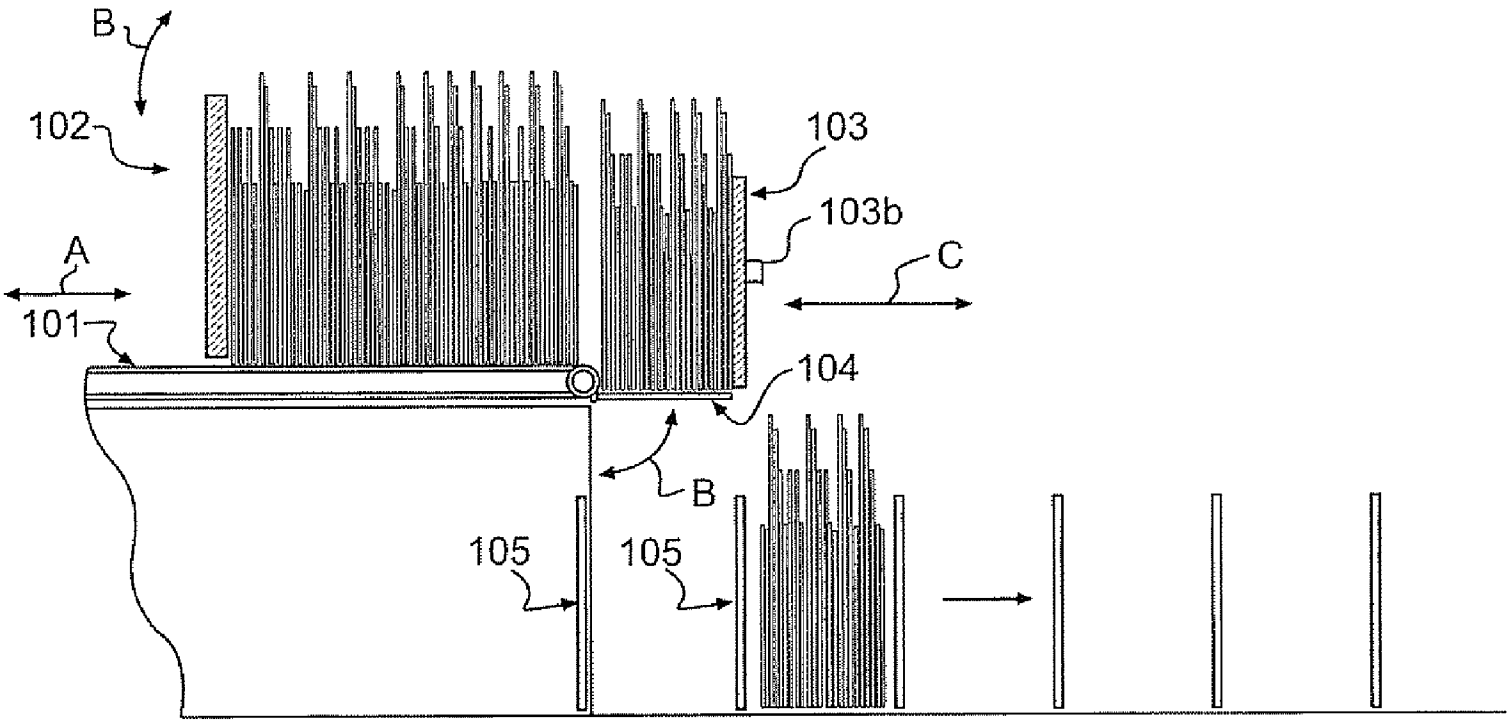
FIG. 4 shows the loading system of the invention in a stage of operation.
Figure 5:
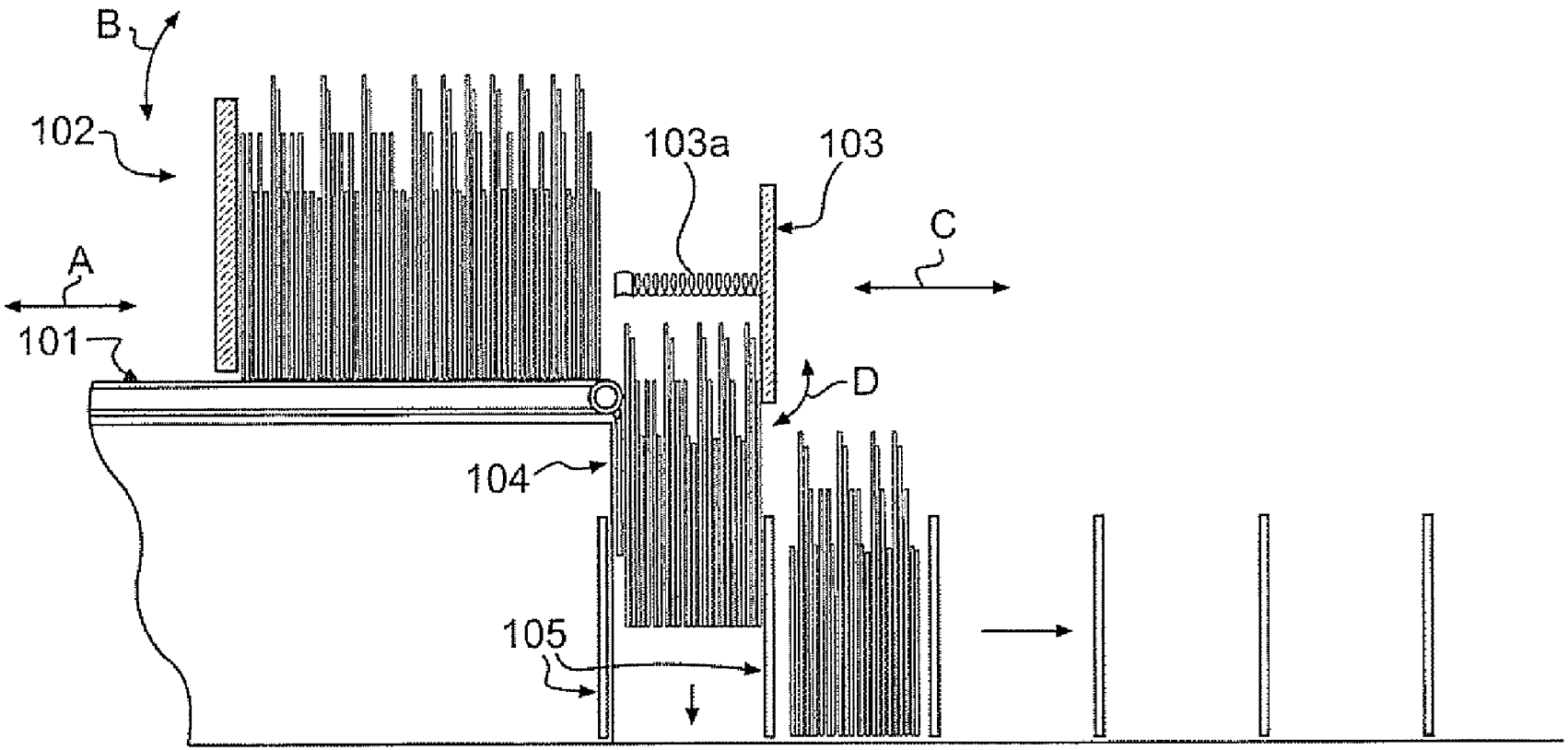
FIG. 5 shows the loading system of the invention in a stage of operation.

FIGS. 3–5 show stages of operation of the loading system. In FIG. 3, the product is initially placed on the conveyor 101, between the plates 102 and 103. The plate 102 is in the down position, proximate the conveyor 101, and the drop gate 104 is in the upper position. The spring load of the plate 103 places a force on the product. The conveyor 101, in this stage, may be stationary. A bundle of product is shown to be placed between one set of paddles 105 on the feeder away from the release section.

FIG. 4 shows the product placed on the conveyor 101, between the plates 102 and 103. In this stage, the plates 102 and 103 and the conveyor 101 are incrementally indexed in a synchronized movement. That is, as the product is moved within the metering section by the plate 102 and conveyor 101, the plate 103 is moved a same distance. The paddles 105 will align with the metering section prior to the product being metered into the compartments (defined by the paddles 105). This may be controlled by the controller, which tracks the movement of these components and accounts for the asynchronous nature of the movement of the paddles 105 in relation to the movement of the conveyor 101 and the plates 102 and 103. This asynchronous movement may allow the product such as mail pieces to properly settle within the metering section prior to the compartment defined by the paddles aligning with the metering section (e.g., drop off area). This ensures that the metered product is staged and ready when the compartment defined by the paddles 105 is in the correct position to be filled. In other implementations, the movement the paddles 105 are synchronized in relation to the movement of the conveyor 101 and the plates 102 and 103.

As the product is finally loaded into the metering section, e.g., on top of the drop gate 104, the photodiode 103*a* may become blocked thus indicating to the controller to stop the movement of the conveyor 101 and the plates 102 and 103. Alternatively, a hard stop may be implemented, where a switch is activated by the movement of the plate 103. In this embodiment, the plate 103, for example, activates the switch, and the components will stop moving. In yet another embodiment, the controller, via a stepped motor or other mechanism, may keep track of the movement of the conveyor 101 or the plates 102 or 103, in order to determine when to stop the system.

At the stage shown in FIG. 4, in one implementation, the conveyor 101 may be reversed to provide the defacto separation between the product on the conveyor 101 and the metering section. Alternatively, or in addition to the reverse movement of the conveyor 101, the knife blade 106 may be lowered to provide such separation. As seen in this figure, the product is loaded onto the metering section, with the drop gate supporting the product above a compartment defined by the paddles 105.

FIG. 5 shows the product being loaded between the paddles. In this stage of operation, the drop gate 104 is opened, e.g., lowered, and the product drops into the compartment defined by the paddles. Again, this may be controlled in synchronized movement by the controller. That is, when the movement of the conveyor, paddles and plates stop, the drop gate or door may be opened automatically at the appropriate alignment with the paddles 105. Once the product is loaded into the compartment, in a same orientation as they are loaded in the metering section, the system will return to the initial stage of FIG. 3 which, again, may be controlled by the controller. This implementation provides a significant total realized throughput increase.

Method of Loading Product Using the System of the Invention

The system of the invention may be used for a single carrier route at a time, multiple routes at once or for warehousing or other sequencing needs of the products. For illustrative purposes and not to limit the invention in any manner, the loading system may be used with a feeder having a feed rate capacity of approximately 10,000 to 40,000 items per hour.

Figure 6:
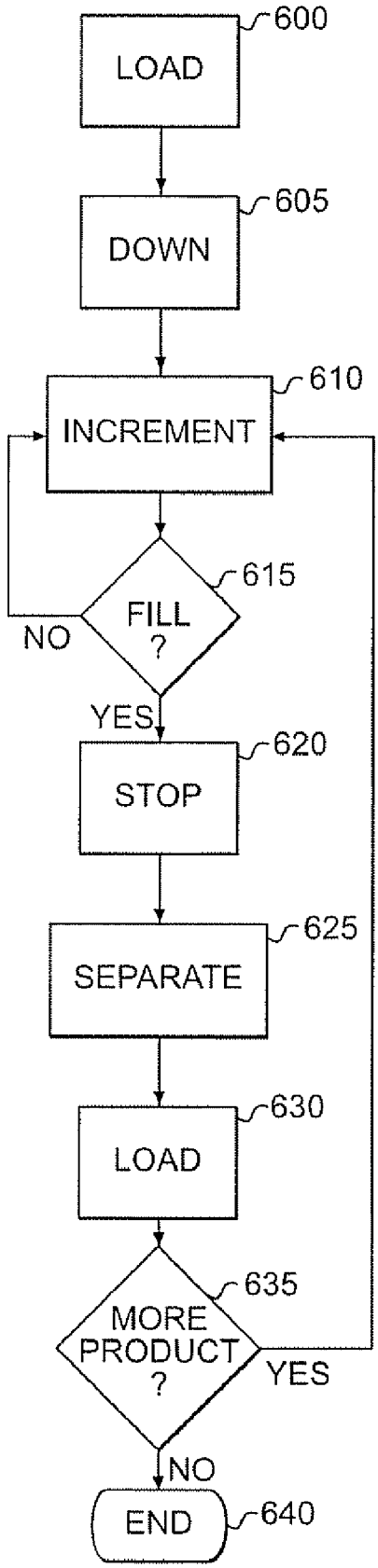
FIG. 6 is a flow diagram showing steps implementing the method of the invention.

FIG. 6 is a flow diagram showing the steps of implementing the method of the invention. The steps of the invention may be implemented on computer program code in combination with the appropriate hardware. This computer program code may be stored on storage media such as a diskette, hard disk, CD-ROM, DVD-ROM or tape, as well as a memory storage device or collection of memory storage devices such as read-only memory (ROM) or random access memory (RAM). FIG. 6 may equally represent a high level block diagram of the system of the invention, implementing the steps thereof.

In particular, at step 600, the system is loaded with product by placing the product on the conveyor, between the plates. At step 605, the plate 102 is positioned downward, proximate the conveyor. At step 610, the conveyor and plates are incrementally moved in synchronized movement.

At step 615, a determination is made as to whether product sufficient to fill the compartment on the feeder is placed within the metering section. This may be determined by the movement of the conveyor, the plates or logic within the controller. In one implementation, the photodiode may be blocked by the product or the plate, for example, in order to determine the amount of product. That is, the photodiode may become blocked when the plate is moved a sufficient distance, substantially equal to the space between the paddles.

If sufficient product is not yet within the metering section, then steps 610 and 615 will repeat. If sufficient product is placed within the metering section, then at step 620, the components will stop. At step 625, the product on the conveyor will be separated from the product within the metering section. At step 630, the product will be loaded within the compartments, via the drop gate mechanism. Then, at step 635, a determination is made as to whether any further product has to be loaded onto the feeder. If not, then the system stops at 640. Otherwise, the process returns to step 610.

While the invention has been described in terms of embodiments, those skilled in the art will recognize that the invention can be practiced with modification within the spirit and scope of the appended claims.

Having thus described our invention, what we claim as new and desire to secure by Letters Patent is as follows:

1. A system for loading product, comprising:
- a conveyor movable in at least a first direction; and
- a metering section located proximate to at an end of the conveyor, the metering section including:
  - a plate mechanism movable between a first position proximate the end of the conveyor and a second position remote from the conveyor;
  - a door adapted to be opened to a feeder, the door at least partially supporting a predetermined amount of product and being positioned between a movable distance of the plate mechanism; and
  - an additional plate mechanism configured to move the product positioned between the additional plate mechanism and the plate mechanism so as to cause the product to press against the plate mechanism.

2. The system of claim 1, wherein the product is at least mail pieces.

3. The system of claim 1, wherein the conveyor is a belt conveyor.

4. The system of claim 3, wherein the belt conveyor includes cogs which form grooves thereon.

5. The system of claim 1, wherein the door is a drop gate positioned below a radius of the conveyor at the end.

6. The system of claim 1, wherein the opposing moving plate is movable independent of the conveyor.

7. The system of claim 1, further comprising a sensor for sensing a position of the movable plate mechanism and activating the opening of the door.

8. The system of claim 1, further comprising a controller which synchronizes or coordinates movement of the movable plate mechanism, the conveyor and the door.

9. The system of claim 8, wherein the controller stops movement of the conveyor and the plate mechanism and opens the door when the metering section is filled with product.

10. The system of claim 1, further comprising a solenoid for moving the plate mechanism.

11. The system of claim 1, wherein the plate is spring loaded to position the plate mechanism in an original position after release of the product.

12. The system of claim 1, wherein the plate mechanism presses against the product and the door is openable to release the product.

13. The system of claim 1, wherein the plate mechanism is spring loaded.

14. The system of claim 1, wherein the additional plate mechanism is movable along a direction that is different from a movement direction of the plate mechanism.

15. The system of claim 1, wherein the feeder utilizes a plurality of spaced apart paddles, wherein the paddles are movable between a first position underneath the door to a position downstream of the first position.

16. A system for loading product, comprising:
- a conveyor movable in at least a first direction; and
- a metering section located proximate to at an end of the conveyor, the metering section including:

a plate mechanism movable between a first position proximate the end of the conveyor and a second position remote from the conveyor; and a door adapted to be opened to a feeder, the door at least partially supporting a predetermined amount of product and being positioned between a movable distance of the plate mechanism, wherein the conveyor is movable towards and away from the metering section to, respectively, load product into the metering section and provide separation between the product on the conveyor and the metering section when the metering section is filled.

17. A system for loading product, comprising:

a conveyor movable in at least a first direction;

a metering section located proximate to at an end of the conveyor, the metering section including:

a first plate mechanism movable between a first position proximate the end of the conveyor and a second position remote from the conveyor; and a door adapted to be opened to a feeder, the door at least partially supporting a predetermined amount of product and being positioned between a movable distance of the plate mechanism;

a controller that controls the movements of at least the conveyor, the first plate mechanism, and the door; and at least one of:

a biasing device that applies a spring load against the product; and a biasing device that allows the first plate mechanism to return to an original position after release of the product to a feeder by the door.

18. The system of claim 17, further comprising a feeder comprising a plurality of spaced apart paddles, wherein the paddles are movable between a first position underneath the door to a position downstream of the first position.

19. The system of claim 17, further comprising a second plate mechanism movable between a first position and a second position, wherein, in the second position, the product is arranged between the first and second plate mechanisms.

20. The system of claim 19, wherein the second plate mechanism is movable along a direction that is different from a movement direction of the first plate mechanism.

21. The system of claim 17, further comprising a movable knife blade mechanism configured to move between a first position and a second position, wherein, in the second position, the product is arranged between the movable knife mechanism and the first plate mechanism.

* * * * *